US005312530A

United States Patent [19]

Lindwall

[11] Patent Number: 5,312,530

[45] Date of Patent: May 17, 1994

[54] SURFACE PROCESSING DEVICE

[76] Inventor: Reine Lindwall, Ehrenprisvägen 79, S-59062 Linghem, Sweden

[21] Appl. No.: 906,944

[22] Filed: Jul. 1, 1992

[30] Foreign Application Priority Data

Jul. 1, 1992 [SE] Sweden ..... 9102031

[51] Int. Cl.[5] ..... C25D 17/00

[52] U.S. Cl. ..... 204/206; 134/122 R; 204/268; 204/272

[58] Field of Search ..... 204/141.5, 146, 202, 204/206, 207, 268, 269, 272; 134/122 R

[56] References Cited

U.S. PATENT DOCUMENTS

| | | | |
|---|---|---|---|
| 1,672,061 | 6/1928 | George | 134/122 R |
| 3,270,364 | 9/1966 | Steele | 134/122 R X |
| 3,471,375 | 10/1969 | Cooke et al. | 204/206 X |
| 3,650,935 | 3/1972 | Andersson | 204/206 |
| 3,718,547 | 2/1973 | Cooke et al. | 205/139 |
| 3,926,767 | 12/1975 | Brendlinger et al. | 204/206 |
| 3,975,242 | 8/1976 | Matsuda et al. | 204/206 X |
| 4,106,519 | 8/1978 | Jalil et al. | 134/122 R |
| 4,518,474 | 5/1985 | Podrini | 204/206 |
| 4,811,748 | 3/1989 | Murao et al. | 134/122 R |

FOREIGN PATENT DOCUMENTS

| | | | |
|---|---|---|---|
| 85891 | 5/1984 | Japan | 204/206 |

*Primary Examiner*—Philip R. Coe

*Attorney, Agent, or Firm*—Jacobson, Price, Holman & Stern

[57] ABSTRACT

A surface processing device for cleaning and other surface processing of running material, where the material is passed under movement in a path (19A) through the device, wherein the device is provided with means, comprising an inner cavity (13) that is fed with a processing agent under pressure and has a jet forming slot (20) to direct to the running material a well defined laminar jet of the processing agent under an acute angle.

5 Claims, 1 Drawing Sheet

SURFACE PROCESSING DEVICE

The present invention relates to a surface processing device for running material. In the instant case the expression running material is used to include wires, strips, tubes, and the like, preferably of metal. The invention has been created in connection with works with wire-shaped material of metal, and, therefore, the invention will be disclosed below with reference thereto, however, while not being limited to be utilized only in connection with processing of metal wires.

When a metal wire shall be processed further by a mechanical processing or shall be provided with a superficial cover the surface of the wire has to be free from all kinds of contaminations, e.g. in the shape of oxydes, grease, drawing agents or the like. Usual ways of removing such contaminations are by means of acids or de-greasing agents. In some cases the contaminations are removed mechanically, e.g. by brushing. In processing by means of acids or de-greasing agents the wire is immersed or drawn through a suitable cleansing bath for a predetermined period of time. Often, this procedure is quite time consuming, which makes it difficult to arrange the equipment in question in line with other production equipments. To cut down the processing time at least to some extent it is possible to utilize electrolytic methods, and another way is to utilize ultra sound.

The present invention has aimed at providing a surface processing device, by the utilization of which the running through time of the wire is reduced considerably, as compared to the running through time with the prior art devices.

To the just mentioned end the surface processing device according to the present invention is characterized essentially in that the device is provided with means, comprising an inner cavity that is fed with a processing agent under pressure and has a jet forming slot to direct to the running material a well defined laminar jet of the processing agent under an acute angle, preferably of the order of 40°–70°.

It is particularly advantageous that the jet forming slot is rotational symmetric and surrounds the path, along which the material is passed.

Further, according to the present invention, it is preferred that an electric electrode is disposed in the said cavity, whereby preferably a further electrode is disposed, in the passage direction of the material, slightly spaced from the jet forming slot, whereby a bipolar electrolyte cell is formed.

In a practical embodiment it is preferred, according to the invention, that a plurality of processing units, each having an inner cavity and a jet forming slot are arranged one after the other in the passing direction of the material.

The invention will be disclosed in more details below with reference had to the accompanying drawing.

Figure 1:
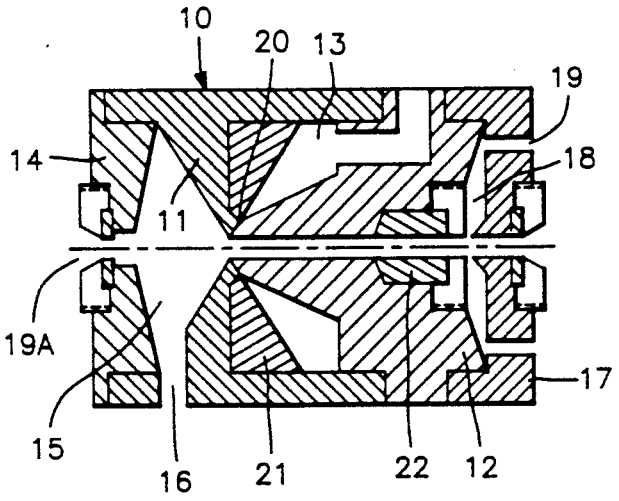
FIG. 1 is an axial longitudinal section of a first embodiment of a surface processing device according to the present invention, picked as an example.

The surface processing device according to the invention as shown in FIG. 1 comprises an essentially cylindrical, tube shaped body, generally denoted 10, which has a transverse wall 11. Into the tube shaped body 10 there is inserted a plug 12 which, together with the transverse wall, defines an annular cavity 13. At its left end, as shown in the drawing, the tubular body 10 is provided with an end wall 14 which, together with a recess in the transverse wall 11, forms a drainage chamber 15 that opens outwardly through an outlet 16.

At the right hand end of the plug 12, as shown in the drawing, there is provided an end wall 17 which, together with the end surface of the plug 12, forms a so called air wiper 18 that is fed with air from the outside through an air inlet 19.

All of the above mentioned details are passed through by a central, axial bore 19A through which the wire (not shown) runs during its passage through the surface processing device according to the present invention.

The annular cavity 13 opens towards the axially throughgoing bore 19A through an annular slot 20, the generatrix of which forms an angle with the centre line of the axially throughgoing bore 19A, viz. an angle of the order of 40°–70°.

In the annular cavity 13 there is arranged an electrode 21, and at the right hand end of the plug 12, as shown in the drawing, there is arranged another electrode 22. In the example both of the electrodes 21, 22 are ring shaped which is conceived as being most advantageous.

In operation, the wire (not shown) is passed with a suitable speed through the axially throughgoing bore 19A in direction from the left towards the right. A suitable cleansing agent is fed to the cavity 13 under a suitable pressure, viz. of the order of 5–15 kp, and emerges through the slot 20 in the shape of an annular, wire surrounding laminar jet of small width, and indeed of such a small width that the jet acts like a knife. This results in that the wire surface is processed by the cleansing agent under a comparatively high pressure, and that the contaminating particles that are freed thereby are quickly passed away from the wire surface to be passed out through the outlet 16.

The electrodes 21 and 22 do not appear to be indispensible for the proper operation of the surface processing device according to the invention but they enhance the cleaning effect further. As shown the electrodes 21, 22 are arranged in such a manner that a bi-polar circuit is formed within the cell. If the electrode 21, which is disposed within the cavity 13, is connected to the minus pole of a rectifier whereas the other electrode 22, which surrounds the thread, is connected to the plus pole of the rectifier, then the wire surface will become anodic under the narrow jet of cleansing agent. Thereby, the resistive layer of solved contaminants and metal iones that surrounds the wire will be dissolved and permits a higher current to pass through the cell, which leads to an accelerated dissolving/cleaning of the thread surface. By tests current densities of more than 1000 $A/dm^2$ and up to ten times that amount have been noted.

If only an anodic or catodic processing of the wire is desired then a contact shoe (not shown) sliding against the running wire may transmit the necessary current.

A further application of the above described surface processing device according to the present invention, besides as a cleansing device, is as a quick plating device, which is possible because of the high flow speed of the electrolyte and the high current density that are possible.

Figure 2:
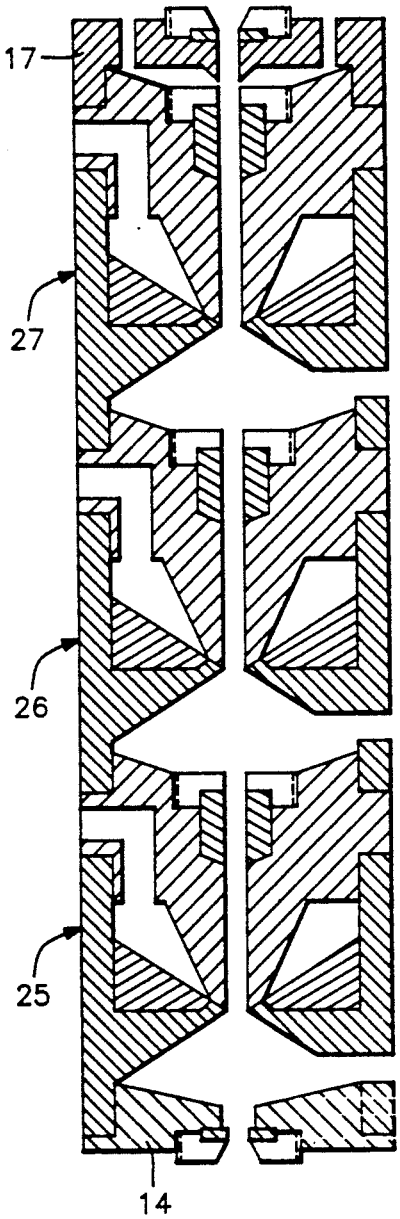
FIG. 2 shows, similarly in an axial longitudinal section, a second embodiment of a surface processing device according to the invention, comprising three so called jet cells, coupled in a series.

A conceived surface processing device according to the invention, adapted for actual production, is shown in FIG. 2. This device comprises three so called jet cells 25, 26, 27 of the general type that has been described above with reference had to the jet cell 10. These jet cells are arranged one after the other and in direct contact with each other in the passage direction of the wire (not shown) and the two outer cells 25, 27 are provided with end walls 14, 17, respectively, in similar way as has been described above. Thereby, the wire shaped material may be flushed with water in one or more of the cells.

A number of modifications and alterations as to details may be carried out within the scope of the invention.

I claim:

1. A surface processing device for cleaning and other surface processing of running material, comprising a body having a throughbore where the material is passed under movement in a path (19*a*) through the device, characterized in that the body is provided with means, comprising an inner cavity (13) that is fed with a processing agent under pressure and has a jet forming slot (20) connecting said cavity with said throughbore to direct to the running material a well defined laminar jet of the processing agent at an acute angle wherein the device includes a bipolar electric cell having a first electrode (21) forming a wall portion of said cavity and a second electrode (22) forming a wall portion of said throughbore downstream from said slot.

2. A surface processing device according to claim 1, characterized in that the acute angle is of the order of 40°–70°.

3. A surface processing device according to claim 1, characterized in that the jet forming slot (20) is rotational symmetric and surrounds the path, along which the material is passed.

4. A surface processing device according to claim 1, characterized in that the jet forming slot has a height/-width ratio of 1:5–10.

5. A surface processing device according to claim 1, characterized in that a plurality of processing units (25, 26, 27), each having an inner cavity (13) and a jet forming slot (20) are arranged one after the other in the passing direction of the material.

* * * * *